US008512420B2

(12) United States Patent
Genisot et al.

(10) Patent No.: US 8,512,420 B2
(45) Date of Patent: Aug. 20, 2013

(54) METHOD AND DYE SOLUTION FOR POLYESTER FABRIC DYEING

(75) Inventors: Robert Genisot, Montreal, WI (US); Steven G. Scharpf, Oshkosh, WI (US)

(73) Assignee: POLY HD, LLC, Oshkosh, WI (US)

( * ) Notice: Subject to any disclaimer, the term of this patent is extended or adjusted under 35 U.S.C. 154(b) by 0 days.

(21) Appl. No.: 13/217,219

(22) Filed: Aug. 24, 2011

(65) Prior Publication Data

US 2013/0047350 A1 Feb. 28, 2013

(51) Int. Cl.
*D06P 5/12* (2006.01)
*D06P 1/00* (2006.01)

(52) U.S. Cl.
USPC ..... 8/446; 8/636; 8/530; 8/602

(58) Field of Classification Search
USPC ..... 8/532
See application file for complete search history.

(56) References Cited

U.S. PATENT DOCUMENTS 4,186,304 A * 1/1980 Molina ..... 250/302
2006/0106154 A1 * 5/2006 Batty et al. ..... 524/522

* cited by examiner

*Primary Examiner* — Harold Pyon
*Assistant Examiner* — Katie L Hammer
(74) *Attorney, Agent, or Firm* — Alan R. Stewart; Stewart IP Law

(57) ABSTRACT

A dye solution for dyeing polyester fabric including dye, a liquid carrier, an acidic agent, and a thickening agent. The carrier is selected to enhance the permeability of the polyester fabric at a certain temperature so that the dye can penetrate within the fabric. A method of printing designs on polyester fabric including creating a dye solution with water, a dye, a carrier liquid and an acidic solution. The dye solution is applied to the fabric in a desired pattern. The fabric and dye solution are then dried in as drier so that the temperature of the carrier is raised to permit the carrier to enhance the permeability of the fabric and have the dye penetrate the fabric. The carrier is then driven out of the fabric by the dryer and no pressure is applied to the fabric during the drying process.

9 Claims, No Drawings

METHOD AND DYE SOLUTION FOR POLYESTER FABRIC DYEING

BACKGROUND

It is well known how to dye natural clothing, such as but not limited to cotton based clothing. Even when that clothing is made of fabric that includes an amount of polyester or other man-made materials, the same dyeing process may be used even though the polyester portion of the fabric will remain un-dyed. Dyeing of cotton or partially cotton fabric is simple and permanent, with the dye being readily absorbed into the threads at ordinary temperatures and pressures. The process of dyeing a cotton-fabric garment is conventionally akin to printing on the garment.

However, when the fabric used to made garments is composed of mostly or entirely of polyester, the process of dyeing may be much more involved. To drive the dye into the threads of the material, which ordinarily would not absorb fluids, the fabric needs to be subjected to a great deal of pressure and/or temperature. Such pressure and temperature may damage or visually mar the garment.

These issues with damages due to heat and pressure are magnified when the polyester fabric is designed to be hydrophobic or moisture wicking. These "high tech" fabrics are becoming more and more prevalent in the athletic and sportswear industries and are also rising in popularity in other garments as well. The heat and pressure can damage the porosity of the fabric or alter the desired sizes of the openings that aid the transport of moisture away from a user of the garment.

The use of conventional garment printing techniques, such as but not limited to screen printing or sublimation, without the use of the undesirable pressure and temperature, may also result in a less than ideal final product. If the dye is not driven into the threads of the fabric itself, the dye will merely sit on the fabric and not be a permanent change to the fabric. These non-penetrating dyes may eventually flake or wear off. In addition, the dyes may also serve to clog the pores and inhibit the moisture transfer abilities of the fabric.

Improvements to the methods and dyeing solutions for dyeing polyester fabric are desirable.

DESCRIPTION

Reference will now be made in detail to exemplary aspects and representative embodiments of the present disclosure. Wherever possible, similar references to elements of the disclosure will be used throughout the description to refer to the same or like parts.

The present disclosure relates to a process that began with the development of what is referred to as "burn out" printing. In this burn out printing process, a garment made of a mixed cotton and polyester fabric would be printed or screened with a solution that included an acid that would eat away or burn out the cotton in desired areas to form a pattern on the garment. Once the solution was applied to the garment, the garment is then washed, removing the cotton residue where the solution was applied. This leaves the polyester only in those burned out areas, creating both a visual and a tactile pattern in the garment. A limitation of this process is that the polyester exposed in the burn out areas could not be dyed or colored without running into the same issues described above with regard to heat and pressure. This limited the creative options for garments treated in such a fashion.

While the areas where cotton remained could be printed or screened in normal fashion, the areas with no cotton in the fabric would be limited to the underlying color of the polyester fabric. While this burn out method did increase the creative options for garment designers, it also introduced a desire to have the ability to simply and quickly dye the exposed polyester. The polyester within the fabric of the garments could be dyed using conventional methods but this raised the cost of the fabric, and thus the garments, and limited the color of the polyester uniform across the entire garment. Alternatively, conventional dying techniques could be used to dye some or all of the exposed polyester threads, but this also increased the complexity of manufacture and therefore also increased the cost of the garments.

In process of refining the burn out technique, it was discovered that some conventional polyester dyes work quite effectively in dyeing polyester in an acid environment, such as that provided by the burn out solution. These conventional dyes, that normally would require high pressure and temperature to penetrate the threads of the fabric, would begin to be effective in normal atmospheric conditions in an acid environment. While these dyes were somewhat more effective, the resulting coloration was not fully satisfactory.

Further research and experimentation led to the inclusion of an additional carrier into the dye solution being applied to the fabric. This additional carrier was a phthalamine derivative and in certain temperature conditions, this carrier alters the permeability of the threads of the fabric to allow dye particles to enter and become embedded in the threads of the fabric. Once the carrier is driven off by the application of temperature (at levels much less that required for conventional polyester dyeing and without the application of pressure to the garment), the permeability of the threads of the fabric returns to normal, trapping the dye particles within the thread and permanently coloring the fabric. This new solution permitted the permanent dyeing of the polyester exposed during the burnout process, and colored the polyester only in those areas where the cotton was removed by the acid. Very clean and precise burning out and dye were enabled by this improved method of printing polyester. It is not intended to limit the present disclosure to this specific phthalamine carrier as there are other chemical compounds that may work within the scope of the present disclosure.

It was thought that the process of dyeing polyester could be adapted from the burn out process into a process for dyeing polyester garments where no cotton is present and/or no burning out of the cotton is desired. Conventional dye solutions used did not contain an acid portion at all. Most included water (a generally neutral to slightly basic solvent) or some other base compound that would not work with the phthalamine derived carrier used to prepare the polyester for dyeing. The phthalamine derived carrier requires an acid environment to be effective in preparing the polyester for dyeing. A common burn out acid, such as but not limited to sulphuric acid or phosphoric acid, would create the necessary acid environment, but ordinary dye solutions are basic rather than acidic would not provide the necessary conditions.

A dye solution with a water base, the phthalamine derived carrier, and the dye materials was developed that further included a thickener that created an acidic environment but which did not burn out or otherwise harm the fabric being dyed. The thickener used is an isoparaffinic solvent that also included some proprietary surfactants that were not disclosed by the manufacturer. It is not intended to limit the present disclosure to this particular solvent as there are other possible chemical solutions that would work within the scope of the present disclosure.

The solution as described above then provided the desired ability to permanently dye polyester fabric without the need to apply great amounts of heat and pressure to a garment and permitted more conventional printing or screening techniques and devices to be used in the application of dyes to the fabric.

A method was developed that permitted the maximum effectiveness of the dye solution according to the present disclosure. This method may include specification of the percentages of each of the primary constituents of the dye solution, which is comprised of a dye, a solvent, a carrier and a thickener. The method may further include the specification of a pore size on the screens through which the dye solution may be forced to apply a pattern to the garment being dyed. The method may further include specification of an amount of pressure to be applied to a squeegee used to press the dye solution through the screen and onto the garment, as well as the angle formed between the squeegee and the screen. The method may also include the specification of the temperature of the drying system through which the garment will be passed after screening, as well as the speed of transit through such a drying system and the number of passes through the drying system that may be required.

The method of the present disclosure may vary based on whether a burn out printing process is to be accomplished or whether a polyester garment is to be printed without burn out. The method of the present disclosure may vary based on the atmospheric conditions under which the screening and drying take place. The method of the present disclosure may vary based on the particle size of the particular dye being used, the intensity of the colors to be applied to the garment, the nature of the underlying fabric of the garment, among other variables.

It is not intended to supply an exhaustive list of variables but rather to lay out the primary elements of the dye solution and a representative or exemplary set of mixing, application and drying parameters within the scope of the present disclosure.

A first exemplary method for printing on a polyester garment may include the following steps:

A) Mix a dye solution according to the present disclosure. The ratios are indicated with respect to the weight of the distilled water used:

1. distilled water
2. 0.5-15% dye(s) depending on the color or intensity desired
3. 5% carrier
4. 10 to 13% thickener B) Apply or screen the dye solution onto a garment. A screen preferably between 180 and 380 mesh screens may be used depending on color/intensity and type of print. Utilize a squeegee of preferably 70 durometer. Apply the squeegee to the screen with preferably between 40-60 psi. Preferably use a slow squeegee speed. Multiple screens may be used to create different patterns in different colors on the garment.

(C) Dry the garment after screening. Preferably, the garment is passed through a drier twice. Preferably, the drier is maintained at 340-360 degrees Fahrenheit in a double-chambered drier at a preferred speed of 11 feet/min. The drier will preferably allow for a large volume of air to flow through the drier to assist it carrying away the various liquid elements of the dye solution.

(D) This garment should preferably be washed before wearing.

It is thought that it is in the drier that the permanent infusion of the dye into the threads of the fabric takes place. At an effective temperature, the carrier, in the presence of the acidic thickener, will cause the threads to become permeable to the dye. The dye particles are then carried into the threads. As the garment passes through the drier, the carrier is driven off by the heat and airflow, rendering the threads of the fabric once again impermeable to the dye solution. However, as the threads become impermeable, the dye particles are trapped within the threads, securing a permanent color to the garment. Since the colors are embedded within the threads themselves, the pores of the fabric are not affected by the addition on the color. Therefore, the effectiveness of the garment to transfer moisture in unaffected by the coloration of the garment. Application of mild heat without pressure ensures that the functional characteristics of the fabric will not be adversely affected.

The washing step will remove any remaining residue of the dye solution from the garment, leaving behind only the dye particles that are not trapped within the threads. Inspection of the garment will reveal that the fabric threads and pore size within the printed area will be the same as the fabric threads and pore size in areas of the garment that have not been printed.

It is not intended to limit the present invention to the exemplary ranges of constituents listed above. The dye weight relative to the weight of the water may be less than 0.5% or greater than 15%. The carrier weight relative to the weight of the water may range from 2% to 20%. The thickener weight relative to the weight of the water may range from 5% to 20%. The actual ratio of weights of the various constituent elements of the dye solution may be selected based on the color and desired intensity of the dyes, the effectiveness of the carrier at different levels of acidity, the amount of thickener required to achieve the required level of acidity to have the carrier function effectively, the prevailing atmospheric conditions, the screen mesh size used, the hardness of the squeegee and the pressure applied to the squeegee, the temperature or air flow within the drier, the speed of transit through the drier, or other factors. It is anticipated that separate constituent elements of the dye solution may be used to thicken the solution and to create the desired acidic environment. If possible, the thickener may preferably perform both functions but it is not intended to limit the present disclosure to a single compound serving both functions.

It is anticipated that dye solutions within the scope of the present disclosure may be effective at dyeing polyester fabric at higher or lower temperatures than that described above. The selection of the temperature for the dryer should be based on raising the temperature of the carrier to an effective temperature so that the carrier will open up the fabric threads to receive the dye. The time within the dryer or the speed at which the fabric moves through the dryer should be selected to permit the carrier to reach the desired temperature and permit sufficient penetration of the dye within the fabric before the carrier is driven out of the fabric and the permeability of the threads of the fabric returns to normal.

A second exemplary method for printing on a polyester garment may include the following steps:

The present disclosure further relates to a method of burning out the cotton of a cotton/polyester blend fabric and then dyeing the polyester in the are where the cotton has been removed.

(A)) Mix a burn out dye solution according to the present disclosure. The ratios are indicated with respect to the weight of the burn out acid used:

1. 20% distilled water
2. 0.5-15% dye (depending on color/intensity)
3. 5% carrier
4. 100 g. of standard burnout acid solution (B) Apply or screen the burn out dye solution onto a garment. A screen preferably between 83 and 110 mesh screens may be used depending on color/intensity and type of print. Utilize a squeegee of preferably 70 durometer. Apply the squeegee to the screen with preferably between 40-60 psi. Preferably use a slow squeegee speed. Preferably, two or more passes with the squeegee over the screen will be used. Multiple screens may be used to create different patterns in different colors on the garment.

(C) Dry the garment after screening. Preferably, the garment is passed through a drier twice. Preferably, the drier is maintained at 340-360 degrees Fahrenheit in a double-chambered drier at a preferred speed of 11 feet/min. The drier will preferably allow for a large volume of air to flow through the drier to assist it carrying away the various liquid elements of the dye solution.

(D) Wash the garment and neutralize the dye solution with a sodium carbonate solution or other appropriate basic solution. The washing will remove the cotton that has been attacked by the and fully reveal the coloration of the exposed polyester in the burn out areas.

It is anticipated that the present disclosure may also encompass a combination of traditional screening on a poly/cotton blend garment so that pattern may be applied to the non-burn out areas in addition to the pattern in the burn out areas. The methods and dye solutions of the present disclosure may be combined with each other or with conventional screening and dye processes.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A dye solution for physically dyeing polyester fabric, the polyester fabric made up of a plurality of threads, the dye solution comprising:

a dye;

a phthalamine derived carrier liquid selected to increase the permeability of the threads of the fabric with respect to the dye when the carrier liquid and the fabric are exposed to an acidic environment at normal atmospheric pressures;

an acidic agent; and a thickening agent.

2. The dye solution of claim 1, further comprising the carrier liquid requiring an acidic environment to increase the permeability of the threads of the fabric, and the thickening agent creating an acidic environment in the solution.

3. The dye solution of claim 2, further comprising the thickening agent and the acidic agent being the same compound.

4. The dye solution of claim 3, further comprising the thickening agent and the acidic agent being a isoparaffinic solvent.

5. The dye solution of claim 1, further comprising water.

6. The dye solution of claim 5, wherein the dye comprises about from 0.5 to 15% by weight of the weight of the water.

7. The dye solution of claim 5, wherein the carrier comprises from about 2% to about 20% by weight of the weight of the water.

8. The dye solution of claim 5, wherein the thickening agent and the acidic agent combined comprise from about 5% to about 20% by weight of the weight of the water.

9. A dye solution for physically dyeing blended polyester/cotton fabric, the dye solution comprising:

water;

a dye dispersed in the water;

a phthalamine derived carrier liquid selected to increase the permeability of a plurality of threads of a polyester portion of the fabric with respect to the dye when the carrier liquid and the fabric are exposed to an acidic environment at normal atmospheric pressures;

an acidic solution selected to burn out the cotton of the fabric and create an acidic environment for the carrier liquid.

* * * * *